United States Patent [19]

Marchi et al.

[11] Patent Number: 4,522,109

[45] Date of Patent: Jun. 11, 1985

[54] LEAK-DETECTING HYDRAULIC SYSTEM

[75] Inventors: Gary C. Marchi, Burlington; Richard H. Logan, West Burlington, both of Iowa

[73] Assignee: J. I. Case Company, Racine, Wis.

[21] Appl. No.: 553,692

[22] Filed: Nov. 21, 1983

[51] Int. Cl.[3] ..... F15B 11/08; F15B 13/04

[52] U.S. Cl. ..... 91/420; 91/437; 91/447; 91/452

[58] Field of Search ..... 91/420, 437, 452, 447

[56] References Cited

U.S. PATENT DOCUMENTS

| | | | |
|---|---|---|---|
| 4,063,489 | 12/1977 | Parquet et al. | 91/445 |
| 4,147,093 | 4/1979 | Dunn | 91/510 |
| 4,282,797 | 8/1981 | Hirsch | 91/447 |
| 4,367,673 | 1/1983 | Krueck et al. | 91/420 |

FOREIGN PATENT DOCUMENTS

| | | | |
|---|---|---|---|
| 97502 | 7/1980 | Japan | 91/420 |
| 65403 | 4/1984 | Japan | 91/420 |

*Primary Examiner*—Paul E. Maslousky

*Attorney, Agent, or Firm*—Dressler, Goldsmith, Shore, Sutker & Milnamow, Ltd.

[57] ABSTRACT

A leak-detecting hydraulic system is disclosed for operation of a fluid actuator associated with a front-end loader, a backhoe, or a like implement on a material handling device. Notably, the system includes a leak-detection circuit which normally acts to prevent movement of the implement associated with the actuator by gravity in the event of a failure in one of the hydraulic fluid lines operatively connected with the actuator. Additionally, the system preferably includes a selectively operable float valve which permits fluid flow which bypasses the leak-detection circuit, thus desirably permitting operation of the implement associated with the actuator in a "floating" mode.

5 Claims, 7 Drawing Figures

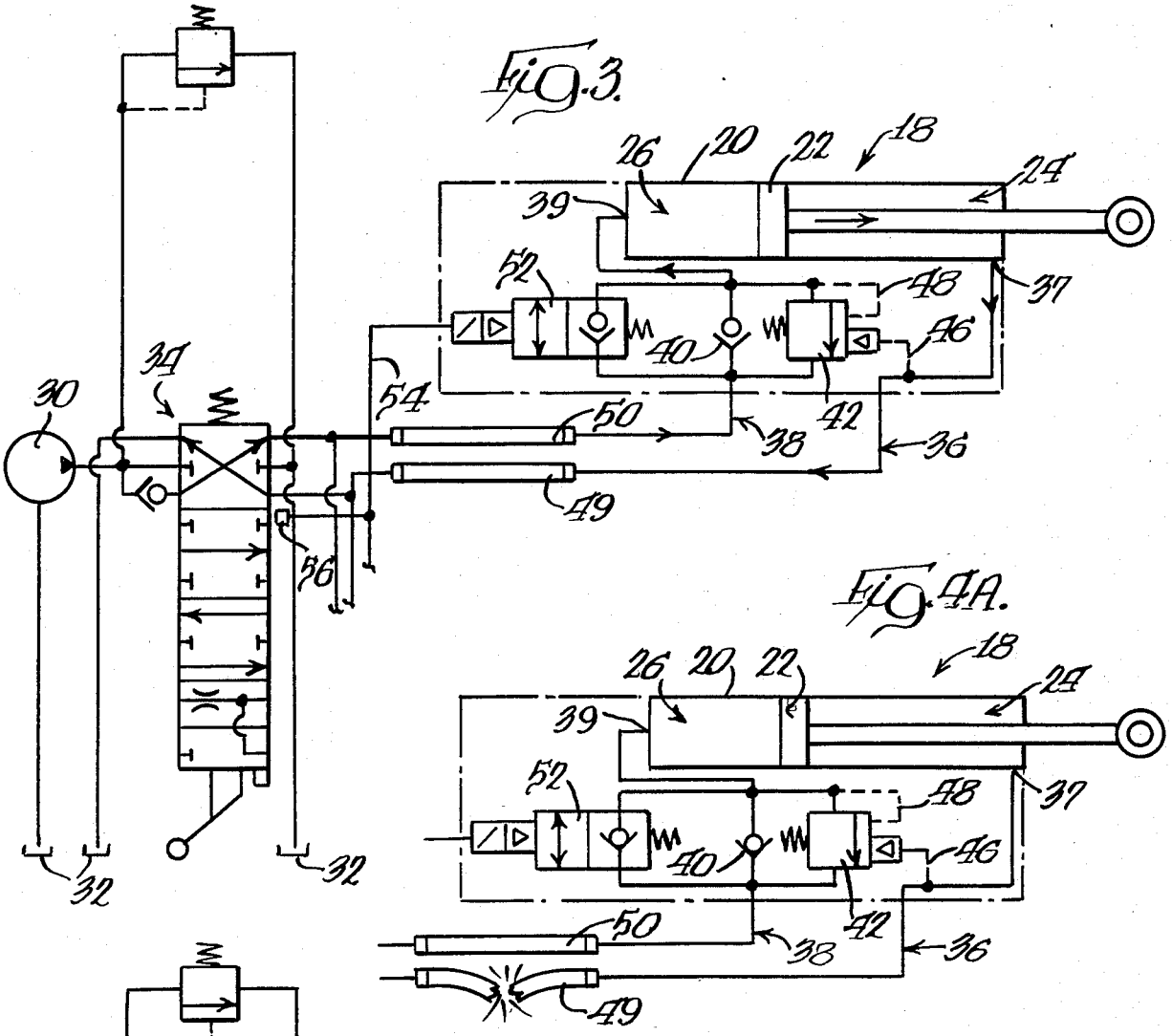
Fig. 3.
Fig. 4A.
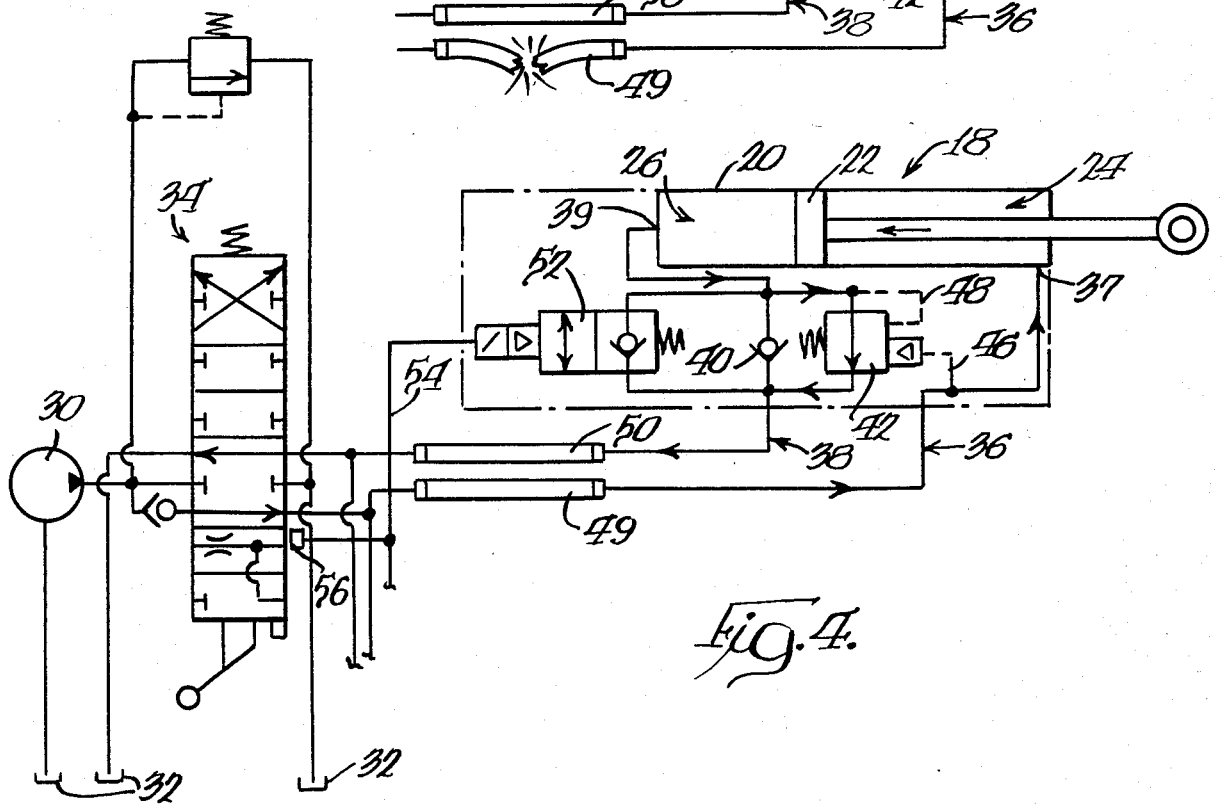
Fig. 4.

LEAK-DETECTING HYDRAULIC SYSTEM

TECHNICAL FIELD

The present invention relates generally to a hydraulic system for operating hydraulically-powered implements on a material handling device or the like, and more particularly to a hydraulic system for operating such an implement which prevents movement of the implement in response to the force of gravity in the event of a leak in the hydraulic fluid supply lines.

BACKGROUND OF THE INVENTION

The versatility of material handling devices is in part provided by their suitability for use under severe operating conditions. Accordingly, such equipment is ordinarily designed to be quite rugged for reliable and trouble-free operation under the rigorous service conditions to which it is subjected. Components of such equipment are selected to resist failure even though vibration and shock loading can be high, and even though such equipment is usually operated in and around dirt, mud, or other debris which can be potentially damaging to the equipment.

Many types of material handling equipment include hydraulically operated implements for effecting material handling functions. A typical piece of equipment includes a hydraulic fluid pump which supplies pressurized hydraulic fluid to hydraulic actuators for selective operation of a implements such as front-end loaders, backhoes, and like articulable devices. As will be recognized, the nature of such equipment frequently makes it necessary to route hydraulic fluids supply lines in relatively unprotected locations. Additionally, the articulable nature of the implements on such equipment frequently mandates the use of flexible fluid supply lines such as hoses and the like. In view of the typically severe conditions to which such equipment is subjected, and because of the high pressure of fluid carried by such fluid supply lines, deterioration and failure of a supply line can occur. While such an occurence usually results in no more than undesired downtime for the equipment for appropriate repair, there are instances where leakage of a fluid supply line can create greater problems. For example, the failure of a fluid supply line which is supplying fluid to an actuator associated with an implement working against the force of gravity (such as a loader bucket) could result in highly undesirable loss of control of the implement.

Therefore, it is extremely desirable to provide a hydraulic system for operating a fluid actuator wherein the system is adapted to detect the occurances of leaks therein, and respond in a manner which prevents undesired loss of control of the implement associated with the actuator.

SUMMARY OF THE INVENTION

The present invention comprises a leak-detecting hydraulic system for selectively operating a fluid actuator, wherein the fluid actuator is operatively associated with an implement such as a bucket or the like on a piece of material handling equipment. The system is particularly suited for use wherein the hydraulic actuator is adapted to operate an associated implement against the force of gravity, with the system functioning to prevent movement of the implement by gravity in the event of failure of a hydralic fluid supply line which supplies pressurized hydraulic fluid to the actuator. In the preferred form, the system comprises a hydraulic fluid actuator having leak-detection means mounted directly thereon to avoid the possibility of a peak developing between the actuator and the leak-detection means.

The present leak-detecting hydraulic system is adapted to selectively operate a fluid actuator having first and second opposing expansible chambers, such as a typical fluid actuator including a cooperating cylinder and piston moveable therein. The system includes a selectively operable, multi-position control valve which, by suitable operator manipulation, directs pressurized hydraulic fluid to a selected one of the chambers of the actuator while receiving fluid from the other of the chambers. The system further includes first fluid passage means joining the first chamber of the actuator with the control valve in fluid communication, and second fluid passage means for joining the second chamber of the actuator and the control valve in fluid communication.

Notably, the second fluid passage means includes a leak-detection circuit. The leak-detection circuit comprises a one-way flow check valve and a pressure counterbalanced valve arranged in parallel flow relation. The one-way flow check valve permits pressurized fluid flow into the second expansible chamber of the actuator while preventing reverse fluid flow therethrough. In distinction, the counterbalanced valve is adapted to the place the multi-position control valve and the second chamber of the actuator in fluid communication only when the cumulative fluid pressure in the second chamber and the first fluid passage means exceeds a predetermined value. By this arrangement, the leak-detection circuit is adapted to permit pressurized fluid flow from the control valve to the second chamber, and is further adapted to prevent fluid flow from the second chamber unless the first fluid passage means is pressurized with fluid. The system is preferably operatively associated with the actuator such that expansion of the second chamber of the actuator operates an associated implement against the force of gravity. Thus, in the event of a failure in one of the first and second fluid passage means, the leak-detection circuit prevents flow of fluid from the second chamber of the actuator, thus preventing movement of the associated implement by gravity.

In the preferred form of the system, the system is adapted to permit "floating" or "return-to-dig" operation of the implement associated with the fluid actuator. Floating refers to the function of an implement wherein the implement is positioned responsively to unevenness in the ground or the like, without fluid pressurization of its associated actuator. Similarly, return-to-dig operation ordinarily refers to movement of an implement downwardly to a digging position from a raised position by the force of gravity, without fluid pressurization of the associated actuator. The present system permits these similar manners of operation by including a preferably solenoid-operated float valve joined in fluid communication with the second fluid passage means of the system. To permit selective operation in the floating mode, the multi-position control valve of the system includes a selectable float position wherein the first and second fluid passage means are joined to each other in fluid communication. Additionally, the control valve is operatively connected with the solenoid-operated float valve so that upon movement of the control valve to its float position, the solenoid-operated float valve is repositioned so that fluid flow through the second fluid passage means bypasses the leak-detection circuit thereof, and flows through the float valve so as to join the first and second expansible chambers of the actuator in fluid communication with each other.

Numerous other advantages and features of the present invention will become readily apparent from the detailed description, the accompanying drawings, and the appended claims.

BRIEF DESCRIPTION OF THE DRAWINGS

FIGS. 3 and 4 are diagramatic views illustrating normal operation of the present hydraulic system;

FIG. 4A is a partial schematic view of the present system illustrating its function in the event of a failure of one of the pressurized fluid supply lines supplying fluid to the actuator of the system;

DETAILED DESCRIPTION

Figure 1:
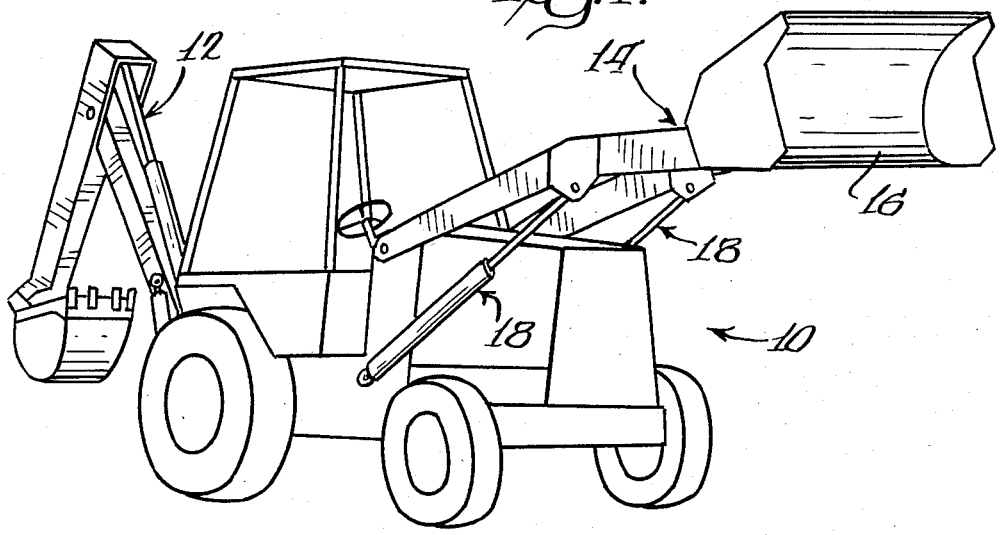
FIG. 1 is a perspective view of a typical piece of material handling equipment including a hydraulic system embodying the present invention.

While the present invention is susceptible of embodiment in various forms, there is shown in the drawings and will hereinafter be described at presently preferred embodiment, with the understanding that the present disclosure is to be considered as an exemplification of the invention, and is not intended to limit the invention to the specific embodiment illustrated.

With reference first to FIG. 1, therein is illustrated a typical material handling device, shown as a tractor 10. For versatility of operation, tractor 10 has mounted thereon a hydraulically-operated backhoe 12, and a hydraulically-operated front-end loader 14. As will be recognized by those familiar with the art, raising and lowering of the bucket 16 of loader 14 is effected by a pair of extensible fluid actuators 18, sometimes referred to as fluid motors or rams.

Figure 2:
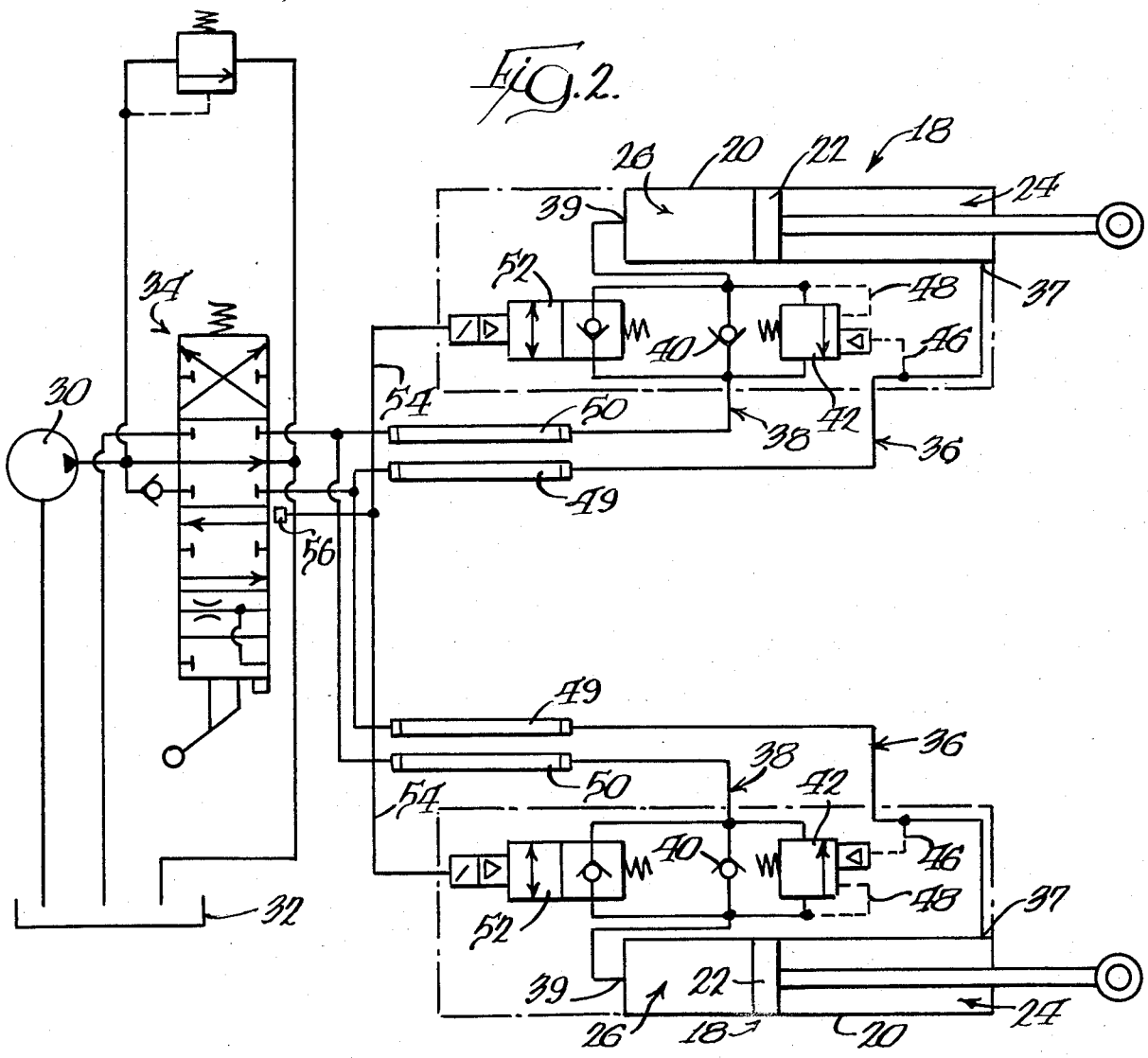
FIG. 2 is a schematic view of the present leak-detecting hydraulic system.

With reference to FIG. 2, therein is illustrated the leak-detecting hydraulic system embodying the principles of the present invention for operation of a fluid actuators 18. It will be noted that for operation of actuators such as 18 which act in concert with each other, the system comprises identical components operatively associated with each of the actuators. However, a system embodying the principles of the present invention is readily suited for operation of a single fluid actuator, or two or more actuators, and thus the system will be herein described with reference to only a single one of the actuators 18 and the components of the present system associated therewith.

As shown in FIG. 2, each actuator 18 includes a cylinder 20 which cooperates with a piston 22 to thus define first and second expansible fluid chambers 24 and 26.

The present leak-detecting hydraulic system includes a suitable source of pressurized hydraulic fluid, typically comprising a hydraulic fluid pump 30 operated by the internal combustion engine of tractor 10. The system further includes a fluid reservoir 32 from which pump 30 draws fluid, and to which return fluid flows.

The present hydraulic system includes a selectively operable, multi-position control valve 34. In the neutral position of control valve 34 shown in FIG. 2, no pressurized fluid flow is directed to actuator 18 from pump 30 via the valve, but rather flow from the pump returns to reservoir 32. In the positions of control valve 34 respectively illustrated in FIGS. 3 and 4, the control valve 34 directs pressurized fluid flow to one of the expansible chambers 24 and 26 of actuator 18, while receiving fluid flow from the other of the chambers for return to reservoir 32.

In a further position of control valve 34 (shown in FIG. 5) the first and second expansible chambers 24 and 26 of fluid actuator 18 are joined in fluid communication with each other, thus permitting "floating" of front-end loader 14, as will be further described.

With further reference to FIG. 2, the present hydraulic system includes a first fluid flow passage, generally designed 36, which joins first expansible chamber 24 of actuator 18 with control valve 34 in fluid communication with each other. Fluid passage 36 is joined to the expansible chamber 24 at fluid port 37. The present system further includes a second fluid passage, generally designated 38, for joining second expansible chamber 26 in fluid communication with control valve 34. As shown, second fluid passage 38 communicates with second chamber 26 at flow port 39.

Significantly, the second fluid passage 38 includes a leak-detection circuit. The leak-detection circuit comprises a one-way flow check valve 40 and a pressure counterbalanced valve 42 arranged in parallel flow relation. Notably, counterbalanced valve 42 includes biasing means which act in opposition to a first fluid pressure-sensing line 46 which is operatively associated with first fluid passage 36, and a second fluid pressure-sensing line 48 which is operatively associated with the second expansible chamber 26 via flow port 39. Thus, the first and second pressure-sensing lines 46 and 48 respectively join, in pressure-sensing relation, the first flow passage 36 and the second expansible chamber 26 with counterbalanced valve 42.

For purposes of illustration, first and second fluid passage 36 and 38 have been illustrated as respectively including flexible conduit portions 49 and 50. Such an arrangement is not uncommon since actuators such as 18 are subject to movement about their mountings during operation.

While the components of the present system thus far described provide the desired leak-detecting operation, the present system preferably includes an arrangement whereby first and second expansible chambers 24 and 26 are joined in fluid communication with each other to permit "floating" of the implement associated with actuator 18 such as front-end loader 14. To this end, multi-position control valve 34 can be manually positioned in a "float" position, shown in FIG. 5, wherein first and second fluid passages 36 and 38 are joined in fluid communication with each other via the control valve. During operation in the floating mode, it is desirable to bypass the leak-detection circuit of the system, and to this end the system includes a solenoid-operated float valve 52 joined in fluid communication with second fluid passage 38. The float valve 52 is disposed in parallel flow relation with flow check 40 and counterbalanced valve 42, and is operatively connected with control valve 34 via a suitable electrical connection 54 and a suitable microswitch or trigger 56. While float valve 52 is preferably electrically-operated, it will be recognized that a valve such as 52 can be otherwise suitably positioned in response to control valve 34 moving into and out of its float position.

Before describing operation of the present system it will be noted that the leak-detection circuit of the system and float valve 52 are preferably mounted integrally on actuator 18, as indicated by the phantom box shown in the drawings. It is contemplated that no piping, either solid or flexible, be interposed between the leak-detection circuit and the expansible chambers 24 and 26, thus obviating problems of leaks going undetected should they occur between the circuit and the cylinder 20 of the actuator itself.

Operation of the present hydraulic system will now be described in detail. As noted, FIG. 2 illustrates control valve 34 in its neutral position, wherein there is no flow into or out of expansible chambers 24 and 26. With reference to FIG. 3, control valve 34 is illustrated in one of its selectable positions wherein pressurized hydraulic fluid flow is directed to second expansible chamber 26 via second flow passage 38, with the control valve 34 receiving flow from first expansible chamber 24 via first flow passage 36. The system is preferably arranged such that operation of actuator 18 by fluid pressurization of second expansible chamber 26 operates the associated implement (i.e., loader 14 in the illustrated embodiment) against the force of gravity.

By comparison of FIGS. 3 and 2, it will be noted that fluid pressurization of second fluid passage 38 by control valve 34 opens flow check 40 to permit flow into chamber 26 via flow port 39. If desired, the system can be arranged such that additional pressurized fluid flow from control valve 34 to chamber 26 is provided via a check valve in float valve 52. During operation in this manner, return fluid flow from first expansible chamber 34 exits via flow port 37 to first fluid passage 36, and is returned to fluid reservoir 32 via control valve 34.

As further shown in FIG. 3, counterbalanced valve 42 remains in its closed condition attendant to fluid pressurization of second chamber 26 from control valve 34. This is because the counterbalanced valve is configured to remain closed unless the cumulative fluid pressure in the second chamber 26 and the first fluid passage 36 exceeds a predetermined value. This predetermined value is selected to be greater than the maximum fluid pressure which exists within second chamber 26 attendant to its fluid pressurization, or which exists within the second chamber when the actuator 18 supports the implement associated therewith (and any load on the implement) against the force of gravity. For example, the maximum pressure within second chamber 26 is ordinarily on the order of 2,000–2,500 pounds per square inch (p.s.i.). Accordingly, counterbalanced valve 42 is configured to open only when the cumulative or total pressure within second chamber 26 and first fluid passage 36 (as sensed via lines 48 and 46) exceeds a relatively greater value, such as 3,000 p.s.i. Since operation of the system as shown in FIG. 3 joins first fluid passage 36 with the system's fluid reservoir 32 via control valve 34, the pressure in the first passage is relatively low. Thus the cumulative pressure sensed by pressure-sensing lines 46 and 48 is less than the predetermined value at which counterbalanced valve 42 is configured to open.

Fluid pressurization of first expansible chamber 24 is illustrated in FIG. 4. As illustrated in FIG. 4, control valve 34 has been shifted to the other side of its neutral position so that pressurized fluid is directed from the control valve via first fluid passage 36 to expansible chamber 24. In order to accommodate return fluid flow from second expansible chamber 26, counterbalanced valve 42 is shifted to its open condition in response to the fluid pressurization of first fluid passage 26 (which is sensed by pressure-sensing line 46) and to the fluid pressure which exists in second chamber 26 (sensed by line 48) attendant to pressurization of first chamber 24. Thus, fluid flow from second chamber 26 to control valve 34 is permitted via counterbalanced valve 42 for return to fluid reservoir 32.

Figure 6:
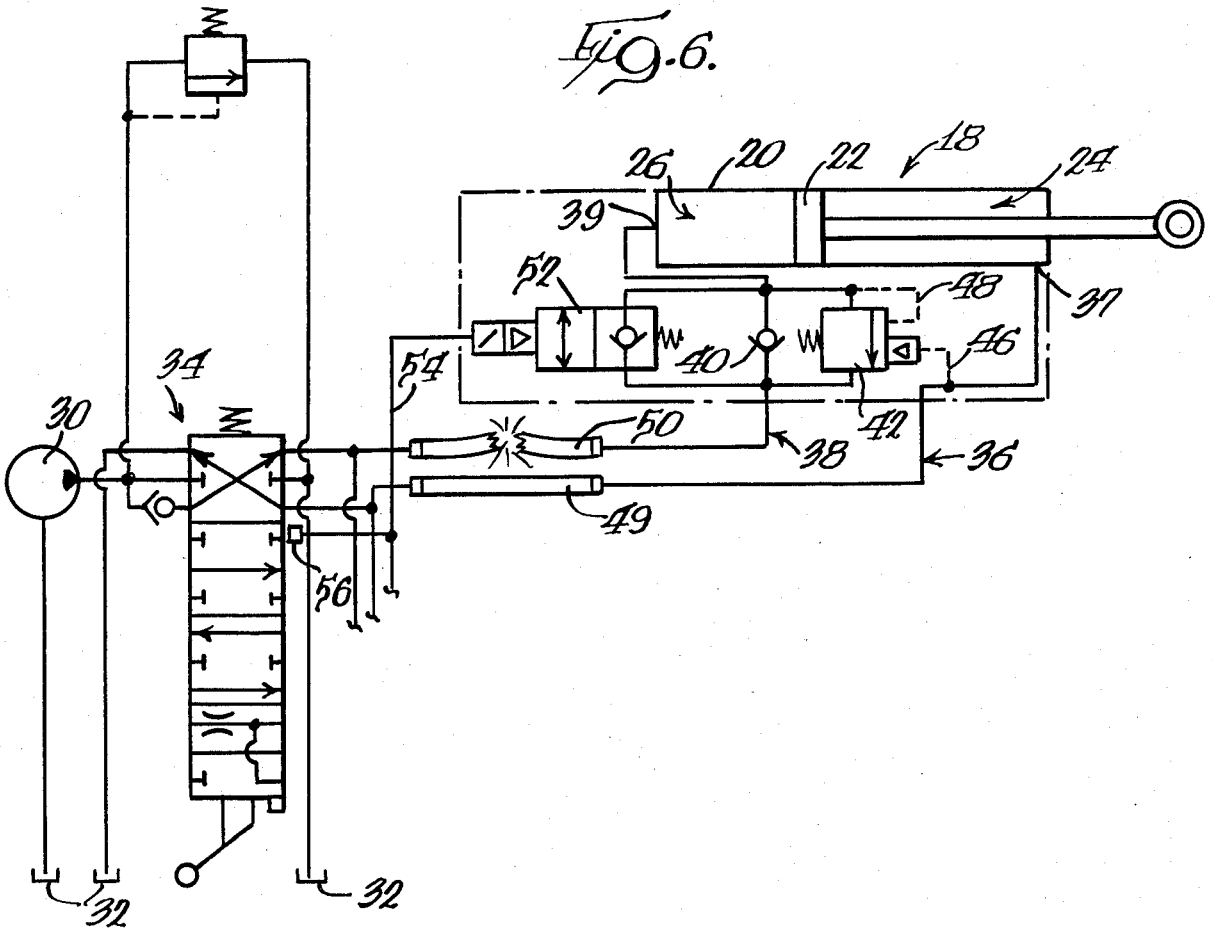
FIG. 6 is a schematic view of the present system illustrating its operation in the event of a failure in the other one of the hydraulic fluid supply lines which supplies pressurized fluid to the actuator of the system.

Referring now to FIGS. 4A and 6, the leak-detecting nature of the present system will be described. FIG. 4A illustrates a leak in first fluid passage 36 attendant to its fluid pressurization, such as by failure of flexible conduit 49. Because of the lack of fluid pressurization of the first fluid passage 36, the cumulative fluid pressure within passage 36 and second chamber 26 is below the predetermined value at which counterbalanced valve 42 opens, and the valve 42 remains in (or shifts to) its closed condition, thereby preventing flow from second expansible chamber 26. Thus, even if the force of gravity is acting upon the implement associated with actuator 18 to move the actuator from an extended condition, the actuator remains fixed since no fluid flow from expansible chamber 26 is permitted.

FIG. 6 illustrates operation of the present system in the event of a failure in second fluid passage 38 attendant to its fluid pressurization, such as by failure of flexible conduit 50. In the event of such a failure, the cumulative fluid pressure within first fluid passage 36 and second chamber 26 is below the predetermined value at which counterbalanced valve 42 opens, and thus the valve 42 remains closed to prevent fluid flow from second expansible chamber 26 of the actuator 18.

Figure 5:
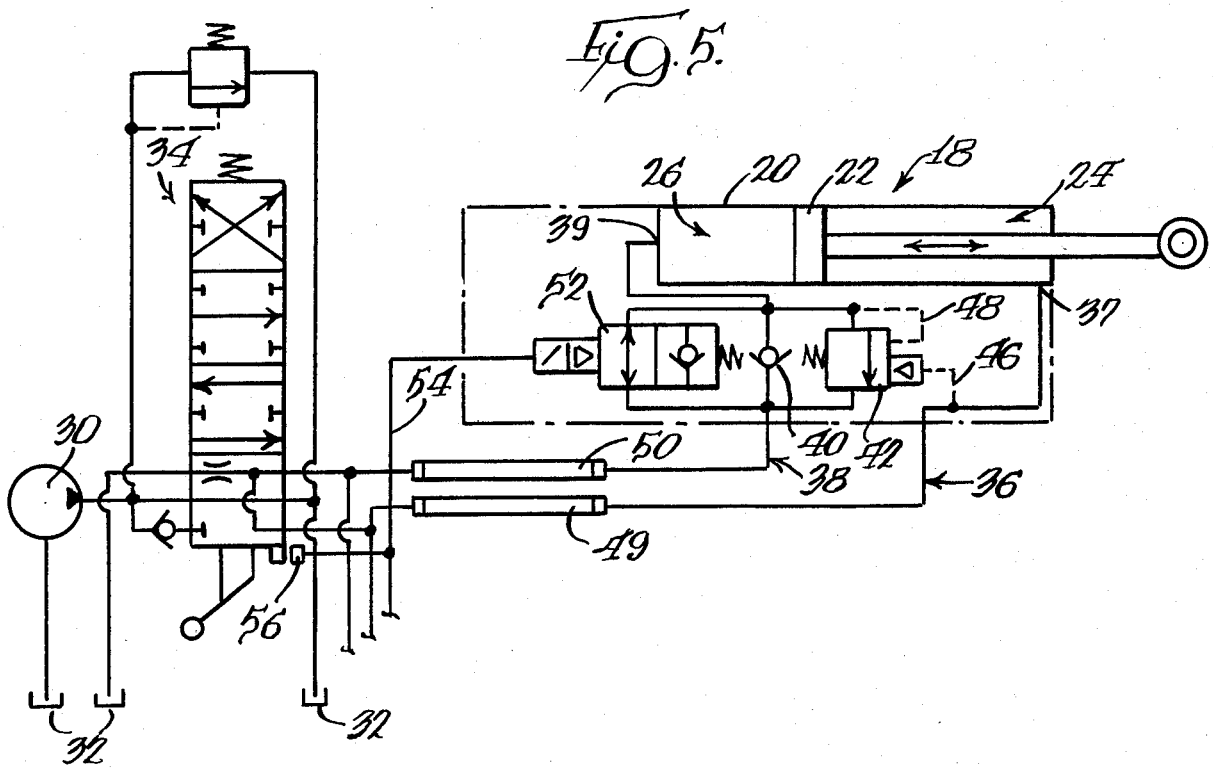
FIG. 5 is a schematic view illustrating operation of the present hydraulic system to permit "floating" of an associated implement.

FIG. 5 illustrates operation of the present hydraulic system in its preferably provided floating mode. As will be noted, FIG. 5 illustrates control valve 34 in its float position, with trigger 56 thus operated to shift or reposition solenoid-operated float valve 52 via electrical connection 54. In this position of control valve 34, first and second fluid passages 36 and 38 are joined in fluid communication with each other via the control valve. The repositioning of float valve 52 permits the flow of fluid in second fluid passage 38 to bypass the leak-detection circuit including check valve 40 and counterbalanced valve 42. Despite the lack of fluid pressurization of the first fluid passage 36, fluid flow from second chamber 26 is permitted in this mode of operation. Thus, first and second expansible chamber 24 and 26 are joined in fluid communication with each other, thereby permitting floating of the implement operatively associated with the actuator 18.

From the foregoing, it will be observed that numerous modifications and variations can be effected without departing from the true spirit and scope of the novel concept of the present invention. It will be understood that no limitation with respect to the specific embodiment illustrated herein is intended or should be inferred. It is, of course, intended to cover by the appended claims all such modifications as fall within the scope of the claims.

What is claimed is:

1. A leak-detecting hydraulic system for selectively operating a fluid actuator having first and second opposing expansible chambers, comprising:

selectively operable, multi-position control valve means for directing pressurized hydraulic fluid to a selected one of said chambers while receiving fluid from the other of said chambers;

first fluid passage means joining said first chamber and said control valve means in fluid communication; and second fluid passage means for joining said second chamber and said control valve means in fluid communication, said second passage means including leak-detection circuit means comprising one-way valve means for permitting pressurized fluid flow into said second chamber while preventing reverse fluid flow through said one-way valve means, and counterbalanced valve means arranged in parallel flow relation with said one-way valve means, first and second pressure-sensing lines respectively joining, in pressure-sensing relation said first fluid passage means and said second expansible chamber with said counterbalanced valve means, said counterbalanced valve means including biasing means acting in opposition to said first and second pressure-sensing lines, whereby said leak-detection circuit means being adapted to permit pressurized fluid flow from said valve means to said second chamber via said circuit means, and being further adapted to prevent fluid flow from said second chamber via said circuit means unless said first fluid passage means is pressurized with fluid.

2. A hydraulic system in accordance with claim 1, wherein said control valve means includes a selectable float position wherein said first and second fluid passage means are joined to each other in fluid communication, said system including float valve means joined in fluid communication with said second fluid passage means, said float valve means being operatively connected with said control valve means whereby when said control valve means is in said float position, fluid flow through said second passage means bypasses said leak-detection circuit means and flows through said float valve means to join said first and second chambers in communication with each other.

3. A hydraulic system in accordance with claim 2, wherein said float valve means comprises a solenoid-operated valve, said system including electrical means operatively connecting said solenoid-operated valve and said control valve means.

4. A fluid actuator having leak-detection means, comprising:

cooperating cylinder means and piston means defining opposing first and second expansible chambers;

first fluid flow passage means in fluid communication with said first chamber for directing pressurized fluid to said first chamber and for receiving fluid therefrom;

second fluid flow passage means in fluid communication with said second chamber for directing pressurized fluid to said second chamber and for receiving fluid therefrom, said second passage means including leak-detection circuit means operatively associated with said first passage means, said leak-detection circuit means comprising a one-way flow check valve for permitting pressurized fluid flow into said second chamber and preventing reverse fluid flow through check valve, and counterbalanced valve means disposed in parallel flow relation with said check valve, said counterbalanced valve means being operatively connected, in pressure-sensing relation, with said first passage means and second second chamber through first and second pressure-sensing lines, respectively, said counterbalanced valve means including biasing means acting in opposition to said first and second pressure-sensing lines whereby fluid pressurization of said first passage means operates to position said counterbalanced valve means in an open condition to permit fluid flow from said second chamber through said counterbalanced valve means, and said circuit means permits pressurized fluid flow into said second chamber via said circuit means, and is further adapted to permit fluid flow from said second chamber through said circuit means only when the cumulative fluid pressure in said second chamber and first passage means exceeds a predetermined value.

5. A fluid actuator in accordance with claim 4, including float valve means joined in fluid communication with said second passage means, said float valve means being selectively operable to permit fluid flow to and from said second chamber which bypasses said leak-detection circuit means.

* * * * *